US012521837B2

(12) United States Patent
Xu et al.

(10) Patent No.: US 12,521,837 B2
(45) Date of Patent: Jan. 13, 2026

(54) UNDERLAYER TOPOGRAPHY METAL RESIDUE DETECTION AND OVERPOLISHING STRATEGY

(71) Applicant: Applied Materials, Inc., Santa Clara, CA (US)

(72) Inventors: Kun Xu, Fremont, CA (US); Harry Q. Lee, Los Altos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 375 days.

(21) Appl. No.: 17/989,741

(22) Filed: Nov. 18, 2022

(65) Prior Publication Data

US 2024/0165768 A1 May 23, 2024

(51) Int. Cl.
*B24B 37/013* (2012.01)
*B24B 37/005* (2012.01)
*B24B 37/04* (2012.01)

(52) U.S. Cl.
CPC ..... *B24B 37/013* (2013.01); *B24B 37/005* (2013.01); *B24B 37/042* (2013.01)

(58) Field of Classification Search
CPC ..... B24B 37/00; B24B 37/005; B24B 37/013; B24B 49/00; B24B 49/04; B24B 51/00
See application file for complete search history.

(56) References Cited

U.S. PATENT DOCUMENTS 5,609,511 A 3/1997 Moriyama et al.
6,399,501 B2 * 6/2002 Birang ..... B24B 49/04 438/692
6,991,516 B1 * 1/2006 David ..... B24B 49/105 451/6
2010/0029177 A1 2/2010 Kobayashi et al.
2014/0093987 A1 4/2014 David et al.
2022/0285227 A1 9/2022 Benvegnu et al.

FOREIGN PATENT DOCUMENTS

JP 2014216457 A 11/2014

OTHER PUBLICATIONS

International Search Report/ Written Opinion issued to PCT/US2023/034505 on Jan. 31, 2024.

* cited by examiner

*Primary Examiner* — C. A. Rivera
(74) *Attorney, Agent, or Firm* — Patterson + Sheridan, LLP

(57) ABSTRACT

An apparatus for processing a substrate, the apparatus comprising a polishing assembly and a controller. The polishing assembly is configured to (a) polish a surface of the substrate. The controller is configured to (b) detect a first substrate measurement corresponding to a first region of the substrate, (c) detect a second substrate measurement corresponding to a second region of the substrate; (d) determine a difference between the first substrate measurement at the first region and the second substrate measurement at the second region; stop the polishing of the surface of the substrate in response to a determination that the difference between the first substrate measurement and the second substrate measurement is within a tolerance threshold; and repeat (a)-(d) in response to a determination that the difference between the first substrate measurement and the second substrate measurement is outside of the tolerance threshold.

18 Claims, 9 Drawing Sheets

UNDERLAYER TOPOGRAPHY METAL RESIDUE DETECTION AND OVERPOLISHING STRATEGY

BACKGROUND

Field

Examples of the present disclosure generally relate to methods, systems, and apparatuses for processing substrates, such as semiconductor substrates. More particularly, an inspection system and methods for use thereof, are disclosed.

Description of the Related Art

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing disk pad or belt pad. The polishing pad can be either a standard pad or a fixed abrasive pad. A standard pad has a durable roughened surface, whereas a fixed-abrasive pad has abrasive particles held in a containment media. The carrier head provides a controllable load on the substrate to push it against the polishing pad. A polishing slurry is typically supplied to the surface of the polishing pad. The polishing slurry includes at least one chemically reactive agent and, if used with a standard polishing pad, abrasive particles.

One problem in CMP is determining whether the polishing process is complete. In other words, whether a substrate layer has been planarized to a desired flatness or thickness, or when a desired amount of material has been completely removed from the surface of the substrate. Overpolishing (removing too much material) of a conductive layer or film leads to increased circuit resistance. However, overpolishing is often necessary to assure that all of a blanket portion of a conductive layer (e.g., portion over the field region of the substrate) has been removed and only the remaining portions of the conductive layer disposed within the features formed in the surface of the substrate remain. On the other hand, underpolishing (removing too little material) of a conductive layer leads to electrical shorts between the circuits formed on the surface of the substrate due to the presence of the remaining portion of the blanket portion of the conductive layer. Traditionally, it is hard to detect an endpoint of a polishing process when the conductive layer becomes discontinuous across the surface of the substrate, such as a point in the polishing process near the end of the process.

Determining an endpoint of a polishing process becomes especially hard where a portion of the blanket film layer is disposed within recesses formed in the surface of the substrate due to prior formed underlying layer surface topology, and thus the remaining portions of a conductive layer form electrical shorts in various regions of the substrate surface. Moreover, variations in the initial thickness of the layer that is to be polished, the slurry composition, the polishing pad condition, the relative speed between the polishing pad and the substrate, and the load on the substrate can cause variations in the material removal rate.

Therefore, there is a need in the art for methods, systems, and apparatuses that improve detection of an endpoint of a polishing process that solves the problems described above, and, more specifically, is able to reduce the likelihood that undesirable discontinuous portions of a polished film layer remain on the surface of the substrate after polishing.

SUMMARY

Embodiments of the disclosure may provide a method for detecting a residue at a substrate, wherein detecting a residue at the substrate comprises receiving a substrate for chemical mechanical polishing; applying a first test signal to the substrate; detecting, in response to the first test signal, a first response corresponding to a first region of the substrate; detecting, in response to the first test signal, a second response corresponding to a second region of the substrate; determining a first test signal measure indicative of a difference in the first response relative to the second response; and providing an indication of a presence of the residue at the substrate in response to the first test signal measure being outside of a tolerance threshold.

Embodiments of the disclosure may provide a polishing apparatus for processing a substrate, comprising a polishing pad support, a carrier head configured to hold a substrate and apply one or more independently controllable pressures to a plurality of regions of the substrate, an in-situ monitoring system to monitor a characteristic of substrate within the plurality of regions during polishing, and a controller. The controller includes computer program instructions that are stored in memory, which when executed by a processor of the controller cause: (a) the carrier head to urge the substrate against a surface of a polishing pad positioned on the polishing pad support, wherein urging the substrate against the surface of a polishing pad includes applying the one or more independently controllable pressures to a surface of the substrate; (b) the in-situ monitoring system to detect a first substrate measurement corresponding to a first region of the plurality of regions of the substrate; (c) the in-situ monitoring system to detect a second substrate measurement corresponding to a second region of the plurality of regions of the substrate; (d) the controller to determine a difference between the first substrate measurement at the first region and the second substrate measurement at the second region; and (e) the controller to either: stop the carrier head from urging the substrate against a surface of a polishing pad in response to a determination that the difference between the first substrate measurement and the second substrate measurement is within a tolerance threshold; or repeat (a)-(d) in response to a determination that the difference between the first substrate measurement and the second substrate measurement is outside of the tolerance threshold.

Embodiments of the disclosure may also provide a polishing system, comprising a polishing assembly configured to polish a surface of a substrate; a controller configured to generate a first series of substrate measurements corresponding with a first region of the substrate, generate a second series of substrate measurements corresponding with a second region of the substrate; determine a slope of the first series of substrate measurements over time; determine a slope of the second series of substrate measurements over time; determine that the slope of the first series of substrate measurements or the slope of the second series of substrate measurements is within a threshold range; and determine a difference between the first series of substrate measurements and the second series of substrate measurements; and stop the polishing of the surface of the substrate in response to a determination that the difference between the first series of substrate measurements and the second series of substrate measurements is within a tolerance threshold; indicate a presence of a residue at the substrate in response to a determination that the first series of substrate measurements and the second series of substrate measurements is outside the tolerance threshold and update an aspect of the polishing operation and repeating (a)-(c) and (f); and indicate a removal of the residue from the substrate in response to a determination that the first series of substrate measurements and the second series of substrate measurements cross into the tolerance threshold.

Embodiments of the disclosure may also provide a method for processing a substrate, the method comprising: polishing a surface of a substrate; detecting a first substrate measurement corresponding to a first region of the substrate; detecting a second substrate measurement corresponding to a second region of the substrate; determining a difference in the first substrate measurement relative to the second substrate measurement; and providing an indication of a presence of a residue at the first region of the substrate or the second region of the substrate in response to the determined difference being outside of a tolerance threshold.

Embodiments of the disclosure may also provide a method that includes urging a substrate against a surface of a polishing pad positioned on a polishing pad support, wherein urging the substrate against the surface of a polishing pad includes applying the one or more independently controllable pressures to a surface of the substrate. Then detecting a first substrate measurement corresponding to a first region of the plurality of regions of the substrate, and detecting a second substrate measurement corresponding to a second region of the plurality of regions of the substrate. Then determining a difference between the first substrate measurement at the first region and the second substrate measurement at the second region, and then either: stoping the carrier head from urging the substrate against a surface of a polishing pad in response to a determination that the difference between the first substrate measurement and the second substrate measurement is within a tolerance threshold; or repeat (a)-(d) in response to a determination that the difference between the first substrate measurement and the second substrate measurement is outside of the tolerance threshold.

BRIEF DESCRIPTION OF THE DRAWINGS

So that the manner in which the above recited features of the present disclosure can be understood in detail, a more particular description of the disclosure, briefly summarized above, may be had by reference to aspects of the disclosure, some of which are illustrated in the appended drawings. It is to be noted, however, that the appended drawings illustrate only typical aspects of this disclosure and are therefore not to be considered limiting of its scope, for the disclosure may admit to other equally effective aspects.

To facilitate understanding, identical reference numerals have been used, wherever possible, to designate identical elements that are common to the Figures. Additionally, elements of one example may be advantageously adapted for utilization in other examples described herein.

DETAILED DESCRIPTION

A method for detecting a residue at a substrate and systems and apparatuses for performing the method, which includes receiving a substrate for chemical mechanical polishing. The method also includes applying a first test signal to the substrate. The method also includes detecting, in response to the first test signal, a first response corresponding to a first region of the substrate. The method also includes detecting, in response to the first test signal, a second response corresponding to a second region of the substrate. The method also includes determining a first test signal measure indicative of a difference in the first response relative to the second response. The method also includes providing an indication of a presence of the residue at the substrate in response to the first test signal measure being outside of a tolerance threshold.

Figure 1:
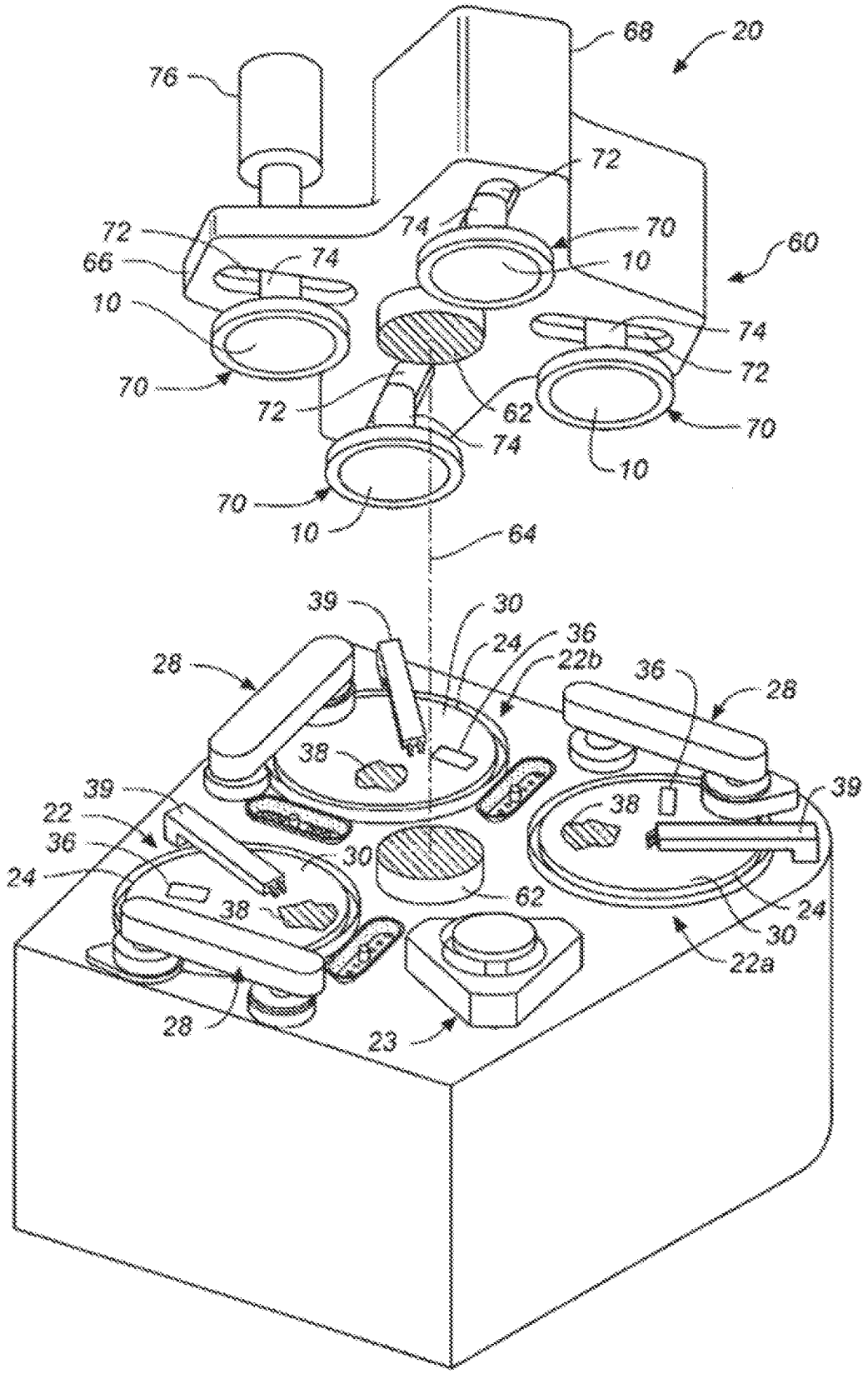
FIG. 1 is a partial exploded view of a polishing apparatus according to one example of the disclosure.

FIG. 1 is a partial exploded view of a polishing apparatus according to one example of the disclosure. In some embodiments, one or more substrates 10 can be polished by a chemical mechanical (CMP) apparatus 20. The polishing apparatus 20 may include a series of polishing stations 22*a*, 22*b* and 22*c*, and a transfer station 23. The transfer station 23 may be configured to transfer the substrates 10 between the carrier heads and a loading apparatus.

Each polishing station includes a rotatable platen 24 on which a polishing pad 30 is positioned. The first and second polishing stations 22*a* and 22*b* can include a two-layer polishing pad with a hard durable outer surface or a fixed-abrasive pad with embedded abrasive particles. The final polishing station 22*c* can include a relatively soft pad or a two-layer pad. Each polishing station can also include a pad conditioner apparatus 28 to maintain the condition of the polishing pad so that it will effectively polish substrates.

Figure 2:
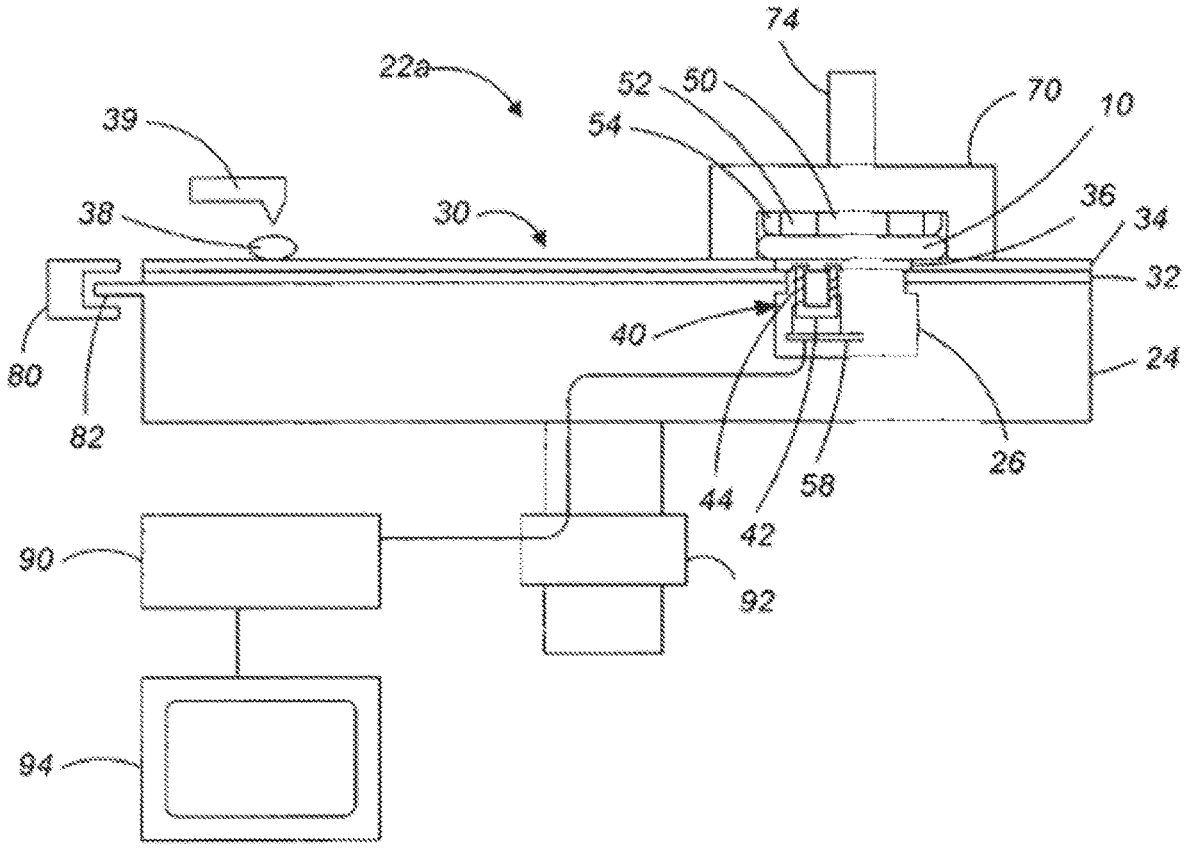
FIG. 2 is a cross-sectional view of the polishing apparatus of FIG. 1 according to another example of the disclosure.

FIG. 2 is a cross-sectional view of the polishing apparatus of FIG. 1 according to another example of the disclosure. In some embodiments, a two-layer polishing pad 30 may include a backing layer 32 which may abut the surface of the platen 24 and a covering layer 34 which is used to polish the substrate 10.

During a polishing operation, a polishing liquid 38, such as an abrasive slurry or abrasive-free solution can be supplied to the surface of the polishing pad 30 by a slurry supply port or combined slurry/rinse arm 39. The same slurry solution may be used at the first and second polishing stations, whereas another slurry solution may be used at the third polishing station.

Returning to FIG. 1, a rotatable multi-head carousel 60 supports four carrier heads 70. The carousel is rotated by a central post 62 about a carousel axis 64 to orbit the carrier head systems and the substrates attached thereto between the polishing stations 22*a*-22*c* and the transfer station 23. Three of the carrier head systems may receive and hold substrates and polish them by pressing them against the polishing pads. In some embodiments, one of the carrier head systems delivers a polished substrate to the transfer station 23 and receives an unpolished substrate from the transfer station 23.

Each carrier head 70 is connected by a carrier drive shaft 74 to a carrier head rotation motor 76 (shown by the removal of a portion of cover 68) so that each carrier head can independently rotate about its own axis. Each carrier head 70 may independently laterally oscillate in a radial slot 72 formed in carousel support plate 66. In operation, the platen is rotated about its central axis, and the carrier head is rotated about its central axis and translated laterally across the surface of the polishing pad.

Figure 3:
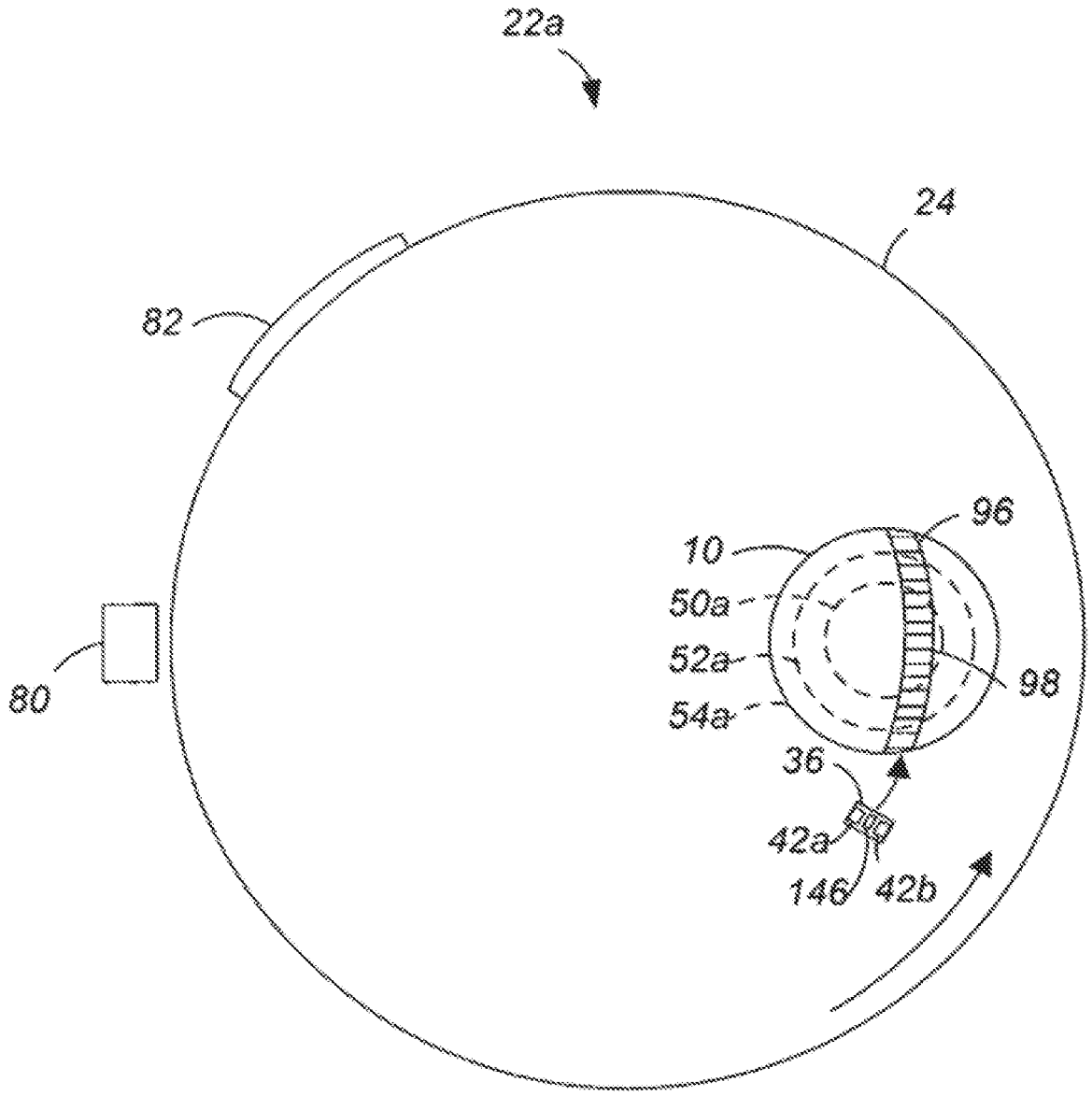
FIG. 3 is a top view of a polishing apparatus according to another example of the disclosure.

In some embodiments, a uniform pressure may be applied to the substrate. In other embodiments, a variable pressure may be applied to different portions or regions of the substrate. As can be seen in FIGS. 2 and 3, the carrier head 70 may independently apply different pressures to different radial regions of the substrate. For example, the carrier head may include mechanical or electro-mechanical elements, such as a flexible membrane with a substrate receiving surface, and three independently-pressurizable concentric chambers 50, 52 and 54 behind the membrane. Thus, the inner circular chamber 50 may apply a pressure to an inner circular region 50*a* of the substrate, the middle annular chamber 52 may apply a pressure to a middle annular region 52*a* of the substrate, and the outer annular chamber 54 may apply a pressure to an outer annular region 54*a* of the substrate which regions or regions can be seen in FIG. 3.

In some embodiments, a recess 26 is formed in the platen 24, and a transparent section 36 is formed in the polishing pad 30 overlying the recess 26. The transparent section 36 may be electromagnetically transparent, optically transparent, or the like. This section 36 may be positioned such that it passes beneath the substrate 10 during a portion of the platen's rotation, regardless of the translational position of the carrier head. Assuming that the polishing pad 30 is a two-layer pad, the transparent section 36 can be constructed by cutting an aperture in the backing layer 32, and by replacing a section of the cover layer 34 with a transparent plug. The plug can be a relatively pure polymer or polyurethane, e.g., formed without fillers. In general, the material of the transparent section 36 should be non-magnetic and non-conductive. In addition, the system can include a transparent cover, e.g., of glass or a hard plastic, that is placed over the recess 26 but is located below the polishing pad (the top surface of the cover can be coplanar with the top of the platen 24). In this case, the core of the eddy current sensor can extend through the cover and project partially into the polishing pad, or be located entirely below the cover (see FIG. 4).

At least one of the polishing stations, e.g., the first polishing station 22*a* or the second polishing station 22*b*, includes an in-situ detection element 40, such as an eddy current monitoring system. The detection element may function as a polishing process control and endpoint detection system. The first polishing station 22*a* can include a single detection element and the final polishing station 22*c* may include another detection element and/or an optical or other detection element.

The CMP apparatus 20 also includes a controller 90 that comprises a programmable central processing unit (CPU) which is operable with a memory (e.g., non-volatile memory) and support circuits. The support circuits are conventionally coupled to the CPU and comprise cache, clock circuits, input/output subsystems, power supplies, and the like, and combinations thereof coupled to the various components of the CMP apparatus 20, to facilitate control thereof. The CPU is one of any form of general purpose computer processor used in an industrial setting, such as a programmable logic controller (PLC), for controlling various components and sub-processors of the processing system. The memory, coupled to the CPU, is non-transitory and is typically one or more of readily available memories such as random access memory (RAM), read only memory (ROM), floppy disk drive, hard disk, or any other form of digital storage, local or remote. Typically, the memory includes computer program instructions, which when executed by the CPU, facilitates the operation of the CMP apparatus 20. The program instructions in the memory are in the form of a program product such as a software algorithm that implements the methods of the present disclosure. The program instructions may conform to any one of a number of different programming languages. In one example, the disclosure may be implemented as a program product stored on computer-readable storage media for use with a computer system. The program instructions of the program product define functions of the embodiments (including the methods described herein). Program instructions and data can be coded and stored within the memory for instructing the CPU. Program instructions readable by the processing unit within the system controller determines which tasks are performable in the processing system. For example, the non-transitory computer readable medium includes a program product which when executed by the processing unit are configured to perform one or more of the methods described herein. Preferably, the program instructions includes code to perform tasks relating to monitoring, execution and control of the measurements, fluid delivery, polishing hardware and movement of a substrate along with the various process recipe tasks.

FIG. 3 is a top view of a polishing apparatus according to another example of the disclosure. In some embodiments, the sensor assembly of the monitoring system is embedded in the platen and sweeps beneath the substrate 10 with each rotation of the platen. Each time the sensor assembly sweeps beneath the substrate, data can be collected from the detection element 40. Specifically, as the sensor assemblies sweep in a path 96 across the substrate, the monitoring systems will make a series of measurements 98 (e.g., ~15 shown). Each measurement 98 can be associated with a radial position or radial region on the surface substrate that is created and defined by use of endpoint detection software running on the controller 90.

The detection element 40 induces and senses eddy currents in a conductive (e.g., metal) layer on the substrate and provides a signal indicative of the measurement to the controller 90. The sensor assembly for the detection element 40 includes a core 42 positioned in the recess 26 to rotate with the platen, and a coil 44 wound around the core 42. The coil 44 is connected to a control system. The control system may be wholly or partially local or remote to the recess 26. For example, the control system may include a printed circuit board 58 inside the recess 26. A controller 90 such as a computer can be coupled to the components in the platen, including the printed circuit board 58, through a rotary electrical union 92.

Figure 4:
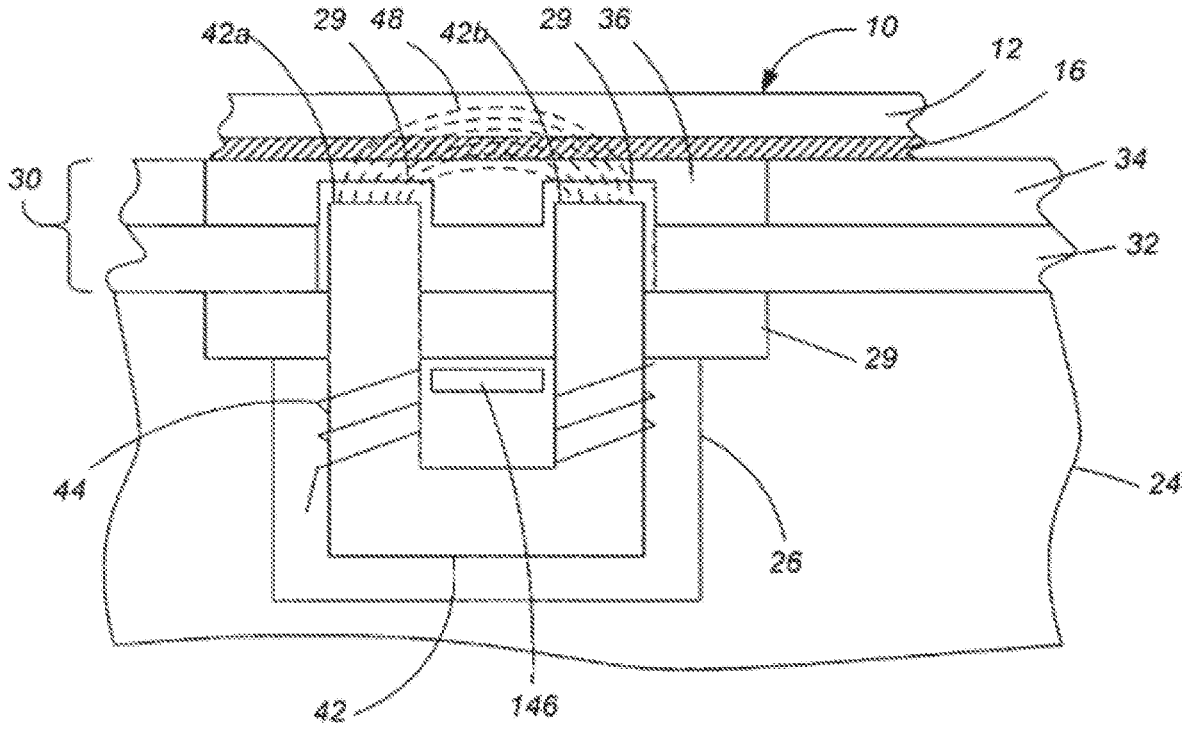
FIG. 4 is a cross-sectional view of a detection element according to another example of the disclosure.

FIG. 4 is a cross-sectional view of a detection element according to another example of the disclosure. In some embodiments, the core 42 can be a U-shaped or E-shaped body formed of a non-conductive material with a relatively high magnetic permeability. The exact winding configuration, core composition and shape, and capacitor size can be determined experimentally. As shown, the lower surface of the transparent section 36 may include two rectangular indentations 29, and the two prongs 42*a* and 42*b* of the core 42 may extend into the indentations so as to be positioned closer to the substrate.

In some embodiments, an oscillator in the controller drives the coil 44 to generate an oscillating magnetic field 48 that extends through the body of the core 42 and into the gap 46 between the two prongs 42*a* and 42*b* of the core. At least a portion of the magnetic field 48 extends through the polishing pad 30 and into the substrate 10. If a metal layer 16 is present on the substrate 10, the oscillating magnetic field 48 generates eddy currents in the metal layer 16. The eddy currents cause the metal layer 16 to act as an impedance source that is coupled to the sense circuitry within or in communication with the controller 90. As the thickness of the metal layer changes, the impedance changes. By detecting this change, the eddy current sensor can sense the change in the strength of the eddy currents, and thus the change in thickness of the metal layer 16.

Figure 5A:
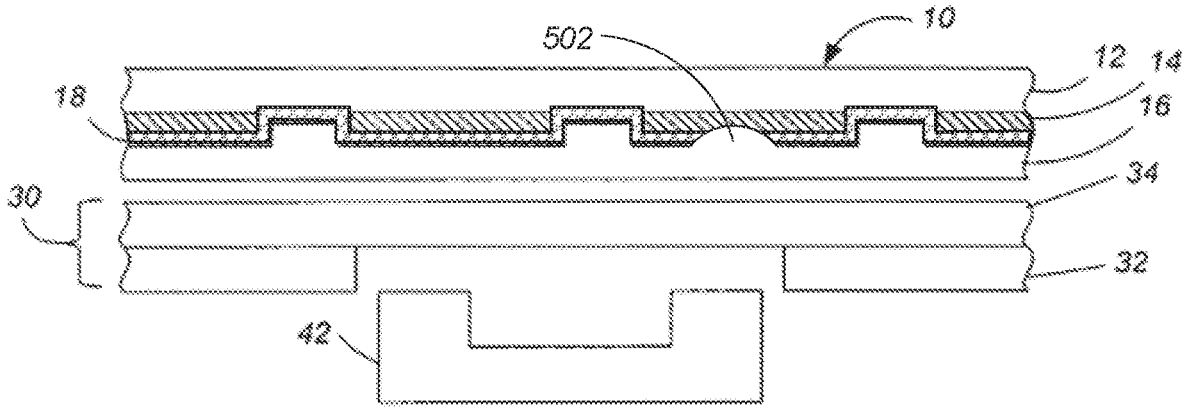
FIGS. 5A-D are cross-sectional views of the detection element during a polishing operation according to examples of the disclosure.
Figure 5B:
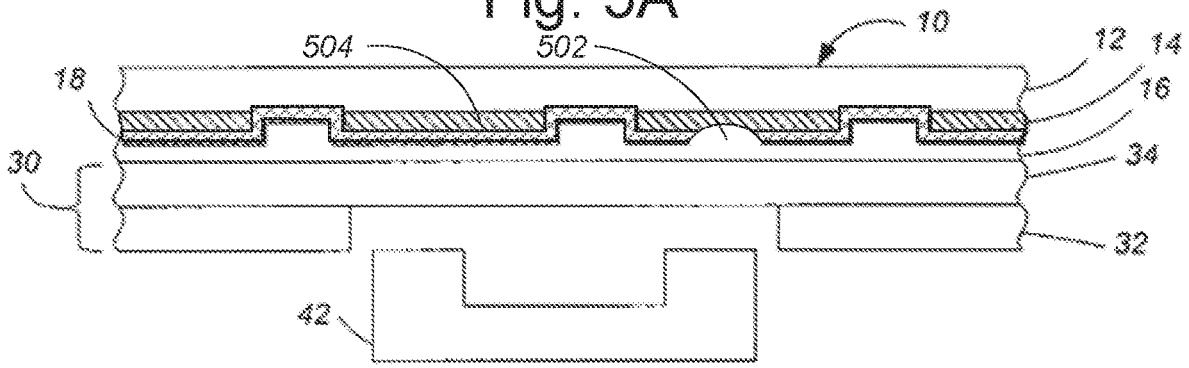

As shown in FIGS. 5A and 5B, for a polishing operation, the substrate 10 is placed in contact with the polishing pad 30. The substrate 10 can include a silicon wafer 12 and a conductive layer 16 (e.g., a metal such as copper, titanium, or the like) disposed over one or more patterned underlying layers 14, which can be semiconductor, conductor or insulator layers. A barrier layer 18, such as tantalum, tantalum nitride, or the like, may separate the metal layer from the underlying patterned layers. In some instances, a flaw may be included in the conductive layer in the form of a residual or residue 502 structure. The residue may be an integration induce underlayer flaw resulting from inconsistent or flawed underlayer topography. In the illustrated embodiment, the residue 502 is formed of conductive material from the conductive layer 16 due to an underlying topographical issue in the surface of the substrate on which barrier layer 18 is disposed. In some embodiments, this residue 502 may extend into the underlying layers 14 resulting in an undesired conductive region formed in the underlying layers 14.

After polishing, the portion of the metal layer remaining between the pattern of the underlying layer formed on the substrate will provide metal features, e.g., vias, pads and interconnects. However, as illustrated in FIG. 5A, prior to polishing the bulk of conductive layer 16 is initially relatively thick and continuous over the field region of the substrate and has a low resistivity, and relatively strong eddy currents can be generated in the conductive layer 16. As previously mentioned, the eddy currents cause the metal layer to function as an impedance source in parallel with the coil 44, which is used to detect the presence of the conductive layer 16.

As illustrated in FIG. 5B, as the substrate 10 is polished, the bulk portion of the conductive layer 16 is thinned. As the conductive layer 16 thins, its sheet resistivity increases, and the eddy currents in the metal layer become dampened. Consequently, the coupling between metal layer 16 and the sensor is reduced (i.e., increasing the resistivity of the virtual impedance source) and the detected impedance increases.

Figure 5C:
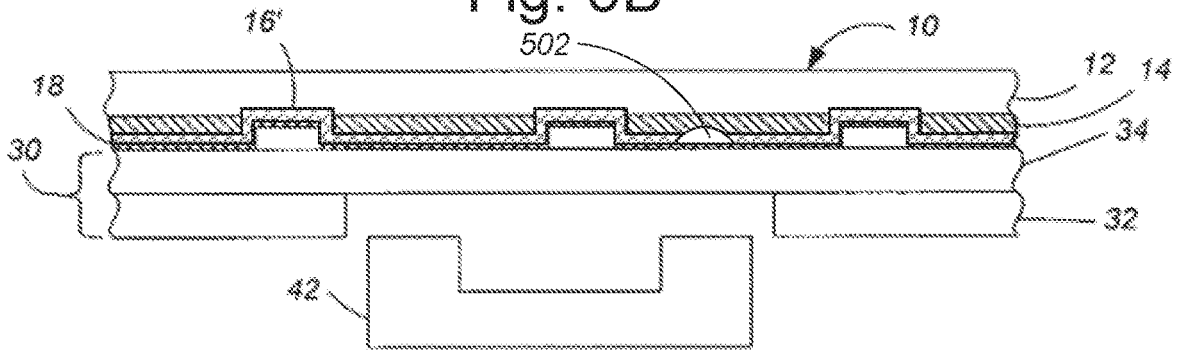

As illustrated in FIG. 5C, eventually the bulk portion of the conductive layer 16 is removed, exposing the barrier layer 18 and leaving conductive interconnects 16' in the trenches between the patterned insulative layer 14 and the residue 502 of conductive layer between the conductive interconnects. At this point, the coupling between the conductive portions in the substrate, which are generally small and generally non-continuous, and the sensor reaches a minimum with the exception of the residue 502 which may result in stronger eddy current signals and readings.

Returning to FIG. 2, the detection element 40 may be positioned within the recess 26 of the platen 24. The detection element 40 can measure the eddy current across portions of the substrate as the platen 24 rotates and the substrate 10 is translated across the surface of the rotating platen 24. Specifically, the detection element 40 is configured to measure a portion of the substrate at a radial distance from the axis of rotation of the platen 24, the measurement associated with a corresponding portion of the substrate 10.

Referring to FIGS. 2 and 3, the CMP apparatus 20 can also include a position sensor 80, such as an optical interrupter, to sense when the core 42 is beneath the substrate 10. For example, the optical interrupter could be mounted at a fixed point opposite carrier head 70. A flag 82 may be attached to the periphery of the platen. The point of attachment and length of the flag 82 is selected so that it interrupts the optical signal of the sensor 80 while the transparent section 36 sweeps beneath the substrate 10. Alternately, the CMP apparatus can include an encoder to determine the angular position of platen. Data corresponding to the relative position of the detection element 40 with the substrate 10 can be used to determine what portion of the substrate 10 (e.g., radial regions) is associated with measurements generated by the detection element 40 on each pass relative to the substrate 10.

Figure 6A:
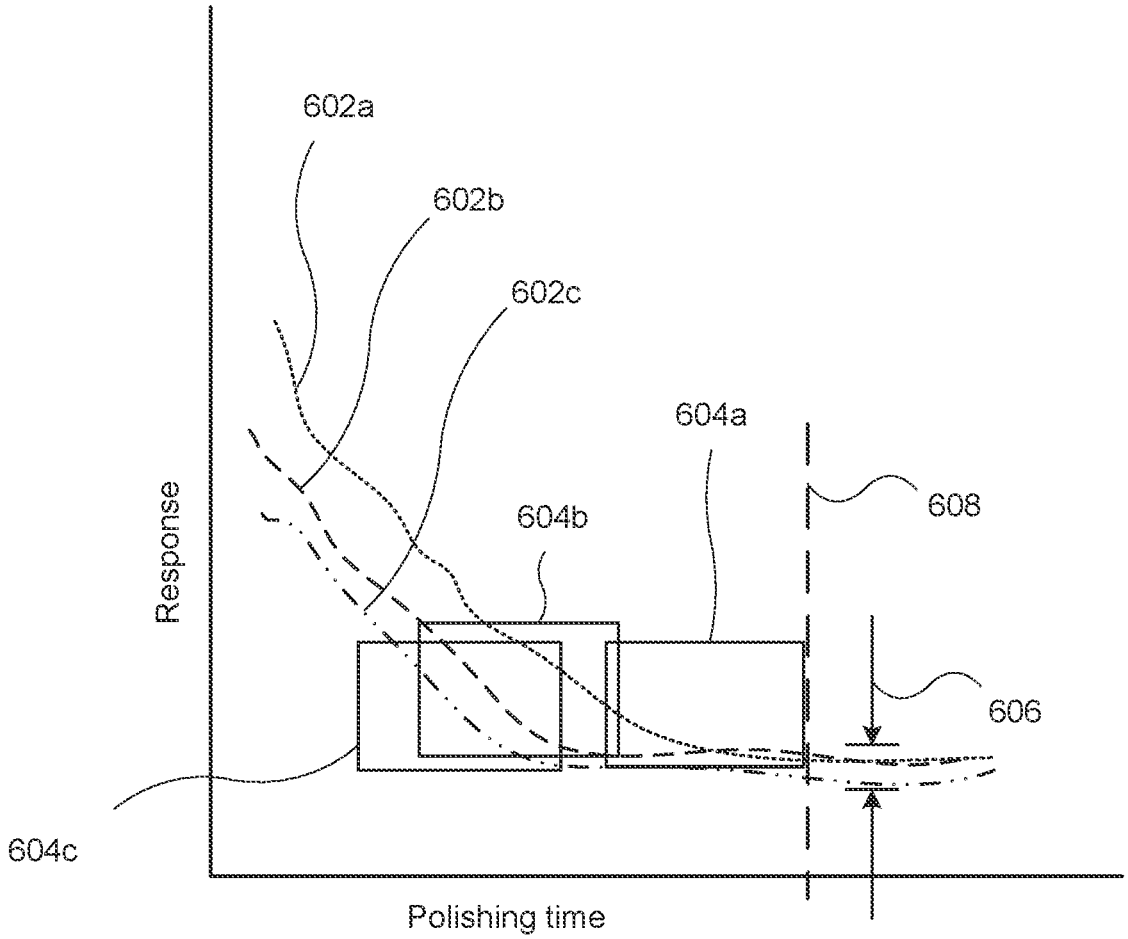
FIGS. 6A-6C illustrate responses to the test signal from corresponding regions of the substrate according to examples of the disclosure.
Figure 6B:
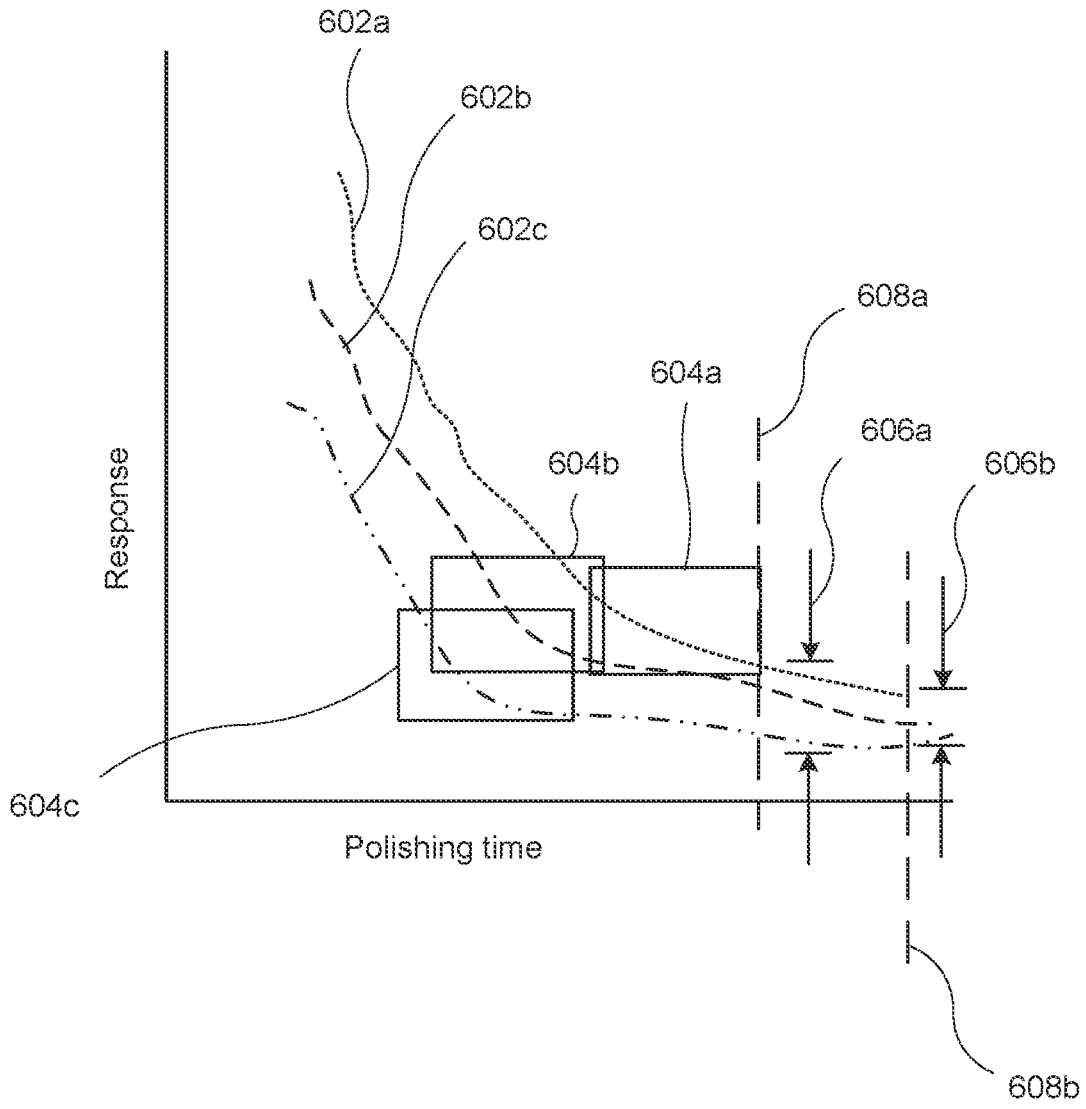
Figure 6C:
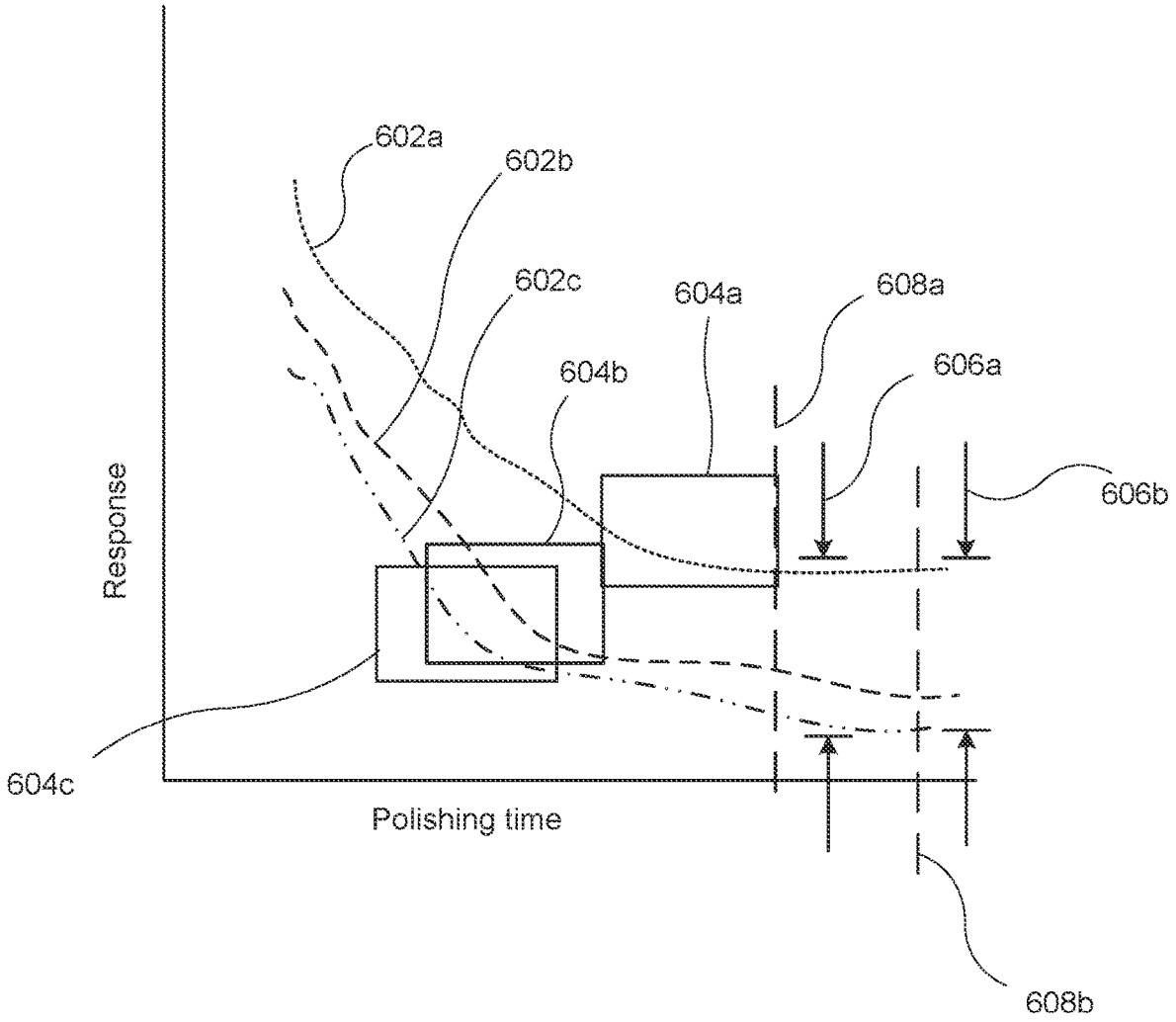

A controller 90, receives signals from the detection element. Since the sensor assembly may sweep beneath the substrate with each rotation of the platen, information on the metal layer thickness and exposure of the underlying layer is accumulated in-situ and on a continuous real-time basis (once per platen rotation). The controller 90 is programmed to take sample measurements from the monitoring system when the substrate passes over the sensor 80. As polishing progresses, the endpoint detection metrics of the metal layer changes, and the sampled signals vary with time. The time varying sampled signals may be referred to as traces, such as shown in FIGS. 6A-6C. The measurements from the monitoring systems can be displayed on an output device 94 during polishing to permit the operator of the device to visually monitor the progress of the polishing operation. In addition, as discussed below, the traces may be used to control the polishing process and determine the end-point of the metal layer polishing operation.

In operation, the CMP apparatus 20 uses the detection element 40 to determine when the bulk of the conductive and barrier layer has been removed and to determine when the underlying patterned insulative layer has been substantially exposed without significant residue. The controller 90 applies process control and endpoint detection logic to the sampled signals to determine when to change process parameter and to detect the polishing endpoint.

FIG. 6A illustrates a response to the test signal from corresponding regions of the substrate according to examples of the disclosure. FIG. 6A includes traces 602*a*, 602*b*, and 602*c* corresponding to a response to a test signal at different regions of the substrate. For example, trace 602*a* may correspond to the inner circular region 50*a* of the substrate (shown in FIG. 3) while trace 602*b* may correspond to the middle annular region 52*a* and trace 602*c* may correspond to the outer annular region 54*a*.

In some embodiments, the controller applies a box logic identifying trends in the traces by use of isolating boxes 604*a-c* that are generated for each of the traces in real-time to determine a convergence of the traces. For example, the box logic may be an algorithm running on the controller 90 that is applied to determine a slope trend in the traces 602*a-c* to identify a steady-state condition indicating a diminishing effect of polishing. The algorithm may be applied over a certain time period or, as shown, may be illustrated upon satisfaction of a target threshold, such as a slope value or trend, a relative change in slope, or the like. Upon, reaching the target threshold, the algorithm may trigger analysis of the convergence of the traces. In some embodiment, one or more of the traces may reach the target threshold indicating the relatively steady-state condition while another of the traces has not reached the target threshold. Polishing may continue until the other of the traces have reached the target threshold, which relates to a property of a trace determined by the box logic. In one example, the target threshold relates to a desired slope of the trace at an instant in time. In one example, the slope of the trace at an instant in time when it reaches a threshold is such that it exits a horizontally oriented box, as shown in FIGS. 6A-6C, through a vertical edge versus through a bottom edge of the box. Once two or more of the traces satisfies the box logic for reaching the target threshold, a convergence of two or more of or all of the traces may be measured. The convergence of the traces may be measured by determining a range of difference 606 between the traces at any given point in time 608 after determining that a box logic threshold has been met. The convergence may be measured by a maximum difference in the traces, a minimum difference in the traces, a standard deviation of the traces, and average deviation of the traces, or apply other comparative analytics. In the illustrated embodiment shown in FIG. 6A, the difference 606 may be within a tolerance threshold indicating that the substrate is sufficiently clear of residue. In some embodiments, the convergence measurement is taken continually during an overpolish or other operation until the traces 602*a-c* reach a target convergence. In other embodiments, the overpolish or other operation may be performed for a dynamic amount of time calculated based on difference needed to reach convergence, or for a fixed amount of time, which is stored in memory of the controller 90, after determining that a box logic threshold has been met.

In some embodiments, the tolerance threshold is a value under which the difference in the traces is sufficient to indicate a lack of residue at the substrate and above which the difference is indicative of a presence of the residue at the substrate. For example, the difference may visually equate to a certain gap between one or more of the traces 602*a-c* and another of the traces. As can be seen in FIG. 6A, the traces are not overlapping but the difference 606 may be small enough that the difference is within the tolerance threshold. The convergence indicates that the measurement from eddy current measurements or other inspection technique has reached a level in art least two or more regions of the substrate 10 have similar amounts of conductive features on the surface of the substrate. Convergence can thus be used to indicate that neither region includes an anomaly such as subsurface residue or the like. The tolerance threshold, which is stored in memory, may be provided manually or may be determined through machine learning, big data analysis, or other automated approaches. The tolerance threshold may be fixed or adjustable by batch, build, and/or other parameters.

FIG. 6B illustrates an embodiment in which the traces 602*a-c* are not within the tolerance threshold at a first time 608*a* as the difference 606*a* is larger than the threshold value stored in memory. As such, an update to the polish operation may be made indicating additional polishing time, a change in slurry application rate, material, or the like, polish pressure, or other aspects of the polish operation. At a second time 608*b*, it may be determined that a convergence of the traces indicates successful removal of the residual material and that no residue is present at the surface of the substrate requiring an update to the polish operation to remove any underlayer residue.

FIG. 6C illustrates an embodiment in which the traces indicate a first difference 606*a* which is not within the tolerance threshold at a first time 608*a*. At a second time 608*b*, the second difference 606*b* remains outside the tolerance threshold. This relative behavior in the trends indicates the presence of a residue at a region of the substrate corresponding to first trace 602*a*. While three separate traces are shown, two or more traces may be used to perform the analysis. In the illustrated embodiment an overpolish operation may be performed to reduce the residue on the substrate. In some embodiments, a notification may be sent to an operator or other portion of a system indicating the detection of residue on the substrate. Further analysis at subsequent times may be performed to determine slopes, convergence, range, or other absolute or relative characteristics of the traces. Updates to the polish operation may be made to reduce the residue to reduce overall yield loss and improve efficiency.

Returning to FIG. 2, in response to the detection of the difference being outside the tolerance threshold, as shown in FIG. 6C, the controller 90 may be programmed to divide the measurements from the detection element 40 from each sweep beneath the substrate into a plurality of measurement regions 98, to calculate the radial position on the substrate for each region, to sort the measurements into radial regions, to determine minimum, maximum and average measurements for each region, and to use multiple radial regions to determine the polishing endpoint.

The controller 90 may also be coupled to a pressure generating mechanisms (e.g., gas supply) that control the pressure applied by the flexible membrane of the carrier head 70 to a substrate, to the carrier head rotation motor 76 to control the carrier head rotation rate, to the platen rotation motor (not shown) to control the platen rotation rate, or to the slurry distribution system 39 to control the slurry composition supplied to the polishing pad. For example, the controller may determine that the endpoint criteria have been satisfied for the outer radial regions but not for the inner radial regions. This would indicate that the underlying layer has been cleared of residue in an annular outer region but not in an inner region of the substrate. In this case, the controller is configured to update the polishing operation.

Figure 5D:
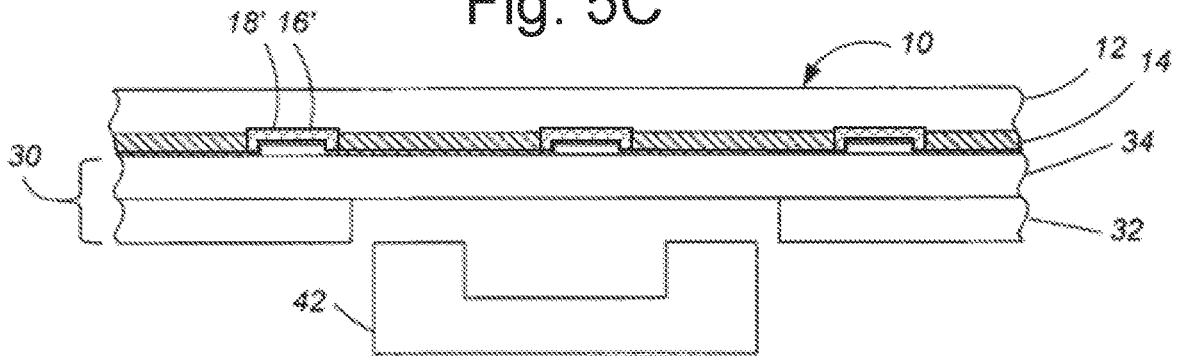

Returning to FIG. 5D, continued polishing and/or an updated polishing operation reduces the residue 502 and sufficiently exposes the underlying insulative layer 14, leaving conductive interconnects 16' and buried barrier layer films 18' in the trenches between the patterned insulative layer 14.

Figure 7:
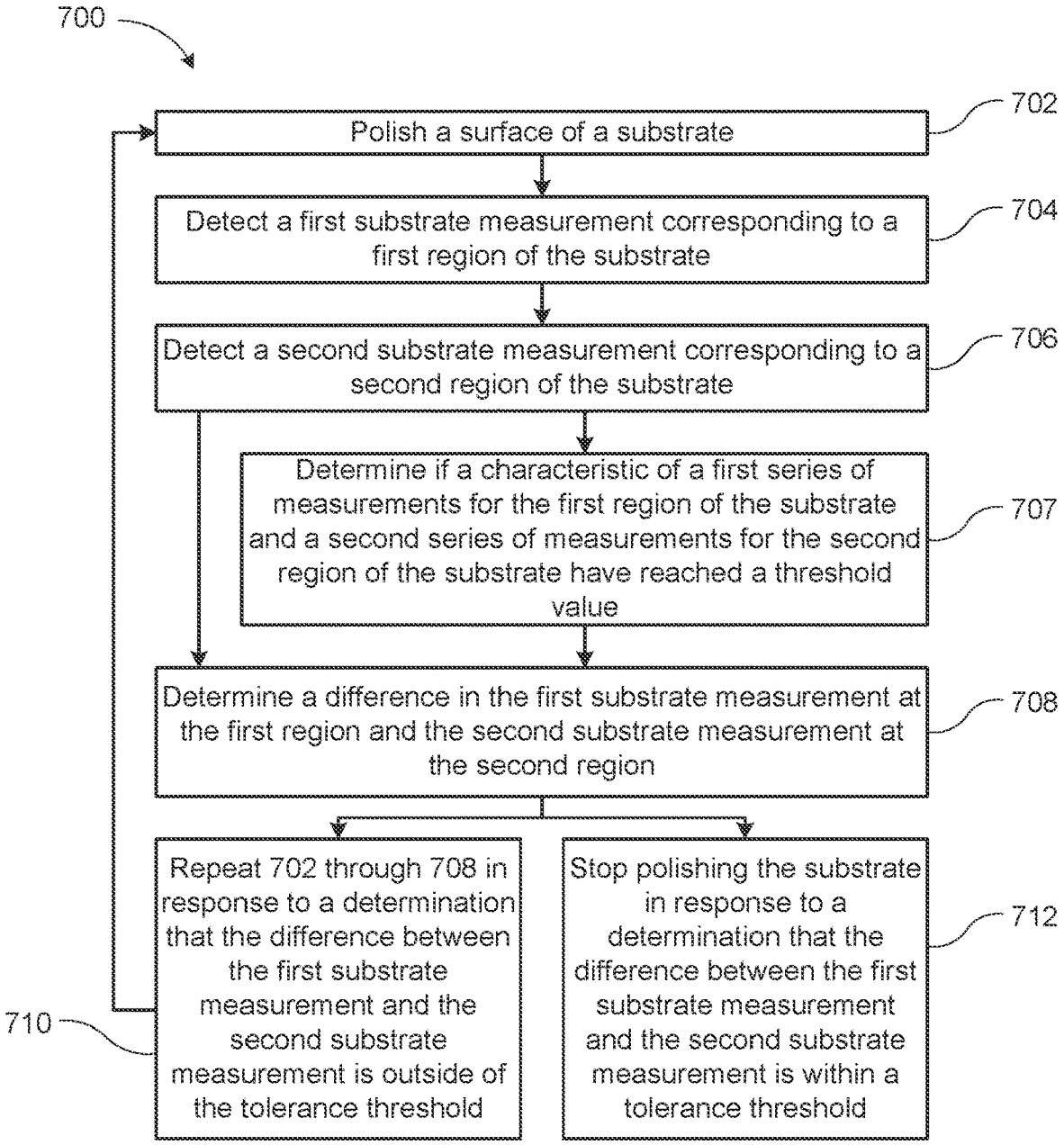
FIG. 7 is a method for detecting a residue at a substrate according to another example of the disclosure.

FIG. 7 is a flow chart of a method 700 according to method examples described herein. The method 700 begins at operation 702. In operation 702, a surface of the substrate 10 is engaged for chemical mechanical polishing, as shown in FIG. 2. The process of engaging the surface of the substrate 10 for chemical mechanical polishing includes, by use of a carrier head 70, to cause the carrier head 70 to hold a substrate 10 and apply one or more independently controllable pressures, by use of the independently-pressurizable chambers 50, 52 and 54 behind the membrane, to a plurality of regions of the substrate 10 to urge the surface of the substrate 10 onto a surface of the polishing pad 30, and thus perform a polishing process on the surface of the substrate 10. Operation 702 also includes the rotation of the polishing pad 30, the rotation of the carrier head 70, the translational relative motion between the carrier head 70 and the polishing pad 30, and the delivery of a slurry composition to the polishing pad surface during the process of chemical mechanical polishing.

In operation 704 of the method 700, a first substrate measurement corresponding to a first region of the substrate is detected. The first substrate measurement may be a response from a middle, inner, or outer region of the substrate. The first substrate measurement may be a response to an eddy current sensor or other detection element 40 as it passes near the substrate, as shown in FIG. 3. The first substrate measurement corresponds to a first region of the substrate. In one example, the first substrate measurement may be a response to an eddy current sensor signal that is detected in response to the delivery of a first test signal provided within the first region on the surface of the substrate, such as a measurement within an outer radial region of the substrate. The outer radial region may extend between a first radius $R_1$ of the substrate and the outer edge of a circular substrate. The first substrate measurement may be recorded as part of a trace that includes a series of detected measurements at different times for a first defined region (i.e., outer region) of the substrate, such as trace 602*a*, as shown in FIGS. 6A-C.

In operation 706, a second substrate measurement corresponding to a second region of the substrate is detected. For example, the second substrate measurement may be a response to an eddy current sensor signal that is detected in response to the delivery of a second test signal. The second substrate measurement corresponds to a second region on the surface of the substrate, such as a measurement within a middle radial region of the substrate. In one example, the middle radial region may extend between the first radius $R_1$ and a second radius $R_2$ of the substrate, where the second radius $R_2$ is smaller than the first radius $R_1$. For example, the second response may be a response from a middle of the substrate, as detected by the detection element 40 as it passes near the middle region of the substrate, as shown in FIG. 3. The second response may be recorded as part of a trace that includes a series of detected signals measured at different times for the second defined region (e.g., middle region) of the substrate, such as trace 602*b*, as shown in FIGS. 6A-C.

Optionally, while not discussed further below for simplicity of discussion reasons, additional measurement operations between operation 706 and operation 708 may be performed. For example, the third substrate measurement may be a response to an eddy current sensor signal that is detected in response to the delivery of a third test signal. The third substrate measurement corresponds to a third region on the surface of the substrate, such as a measurement within an inner radial region of the substrate. In one example, the inner radial region may extend between the center of the substrate and the second radius $R_2$ of the substrate. For example, the third response may be a response from the inner region of the substrate, as detected by the detection element 40 as it passes near the inner region of the substrate, as shown in FIG. 3. The third response may be recorded as part of a trace that includes a series of detected signals measured at different times for the third defined region (e.g., inner region) of the substrate, such as trace 602*c*, as shown in FIGS. 6A-C.

In operation 708, a difference in the first substrate measurement relative to the second substrate measurement is determined. In some embodiments, the difference between the first substrate measurement relative to the second substrate measurement is performed after it has been determined that the characteristic of one or more of traces has reached a threshold value. As illustrated in FIG. 7, the operation of determining that the characteristic of one or more of traces has reached the threshold value is performed during operation 707. For example a change in a characteristic of each of the traces, such as trace 602*a* and 602*b*, may be analyzed to determine if a characteristic of the trace has met some threshold value. In some embodiments, the characteristic of each trace (i.e., series of measured values) that is evaluated is a slope value or trend, a change in slope or other characteristic of the trace. In some embodiments, a box logic may be applied to identify a slope or change in slope that satisfies a threshold range or target value or behavior in the slope. In some examples, the slope may be evaluated to determine a settling or trend in the slope towards a steady state or other behavior, such as the slope of a trace is close to or approaching zero, such as illustrated for the trace 602*a* on the far right side of in FIG. 6A.

In one example, during operation 708 an algorithm executed by a processor within the controller 90 is used to compare the first trace 602*a* to the second trace 602*b* at a point in time 608 to determine a relative difference 606 between the first trace and the second trace after a characteristic of at least one of the traces 602*a*, 602*b* has met some threshold value, as shown in FIGS. 6A-C. The algorithm used to determine the difference between the first substrate measurement relative to the second substrate measurement may be automatically triggered by the analysis of a characteristic of at least one of traces performed in operation 707. In one example, once the first trace and the second trace satisfies the box logic for reaching the target threshold value, the difference (e.g., convergence) between the first substrate measurement relative to the second substrate measurement is performed. Determining a difference 606 at time 608 can be based on the value of the signal provided by the sensor within different regions on the substrate that form the traces, as shown in FIGS. 6A-C.

In operation 710, the controller 90 then uses the determined difference as an indication of a presence of a residue at the first region of the substrate or the second region of the substrate in response to the difference 606 determined in operation 708 being outside of a tolerance threshold stored in memory of the controller 90. For example, the residue 502 may be an integrated inclusion resulting from an underlayer topographical anomaly, as shown in FIGS. 5A-C. The resulting residue may increase the eddy current response (i.e., detected eddy current signal) resulting in a signal level difference in corresponding traces. Determining the difference between traces may allow for identification of the corresponding region in which the residue is located. For example, a measurement from a third region may be compared with the measurements corresponding to the first and second regions to determine which of the first, second, or third regions may be affected by a residue. In one example, the trace 602*a* has an eddy current signal that is significantly higher than the traces 602*b*, and 602*c* on the right side of the graph. This difference can lead the controller 90 to the conclusion that the region forming the trace 602*a* includes some residue, or at least an amount of residue, that exceeds the other regions 602*b* and 602*c* on the substrate.

The operation 710 may include repeating operations 702-708 by updating a chemical mechanical polishing process based on the difference relative to the tolerance threshold determined during operation 708. For example, because the difference is outside the tolerance threshold, additional polishing may be helpful to bring the traces into greater alignment. An update may include increasing at least one of a polishing time, a pressure applied to one or more regions of the flexible membrane of the polishing head, changing a polishing slurry composition, slurry feed rate, polishing head rotation speed, platen rotation speed or the like. In some embodiments, the update to the polishing operation may constitute an overpolish based on the difference from the tolerance threshold. For example, if the difference is well outside the tolerance threshold a more aggressive (e.g., higher flexible membrane pressure, carrier head rotation speed, etc.) or lengthy overpolish may be called by the controller 90. If the difference is near the tolerance threshold, a more mild overpolish may be called. The overpolish may be used to remove excess material and the residue at the substrate, as shown in FIGS. 5A-D.

The operations 702-708 of the method 700 may be performed one or more times if the determined difference performed in operation 708 is outside of a desired threshold. The operations 702-708 of the method 700 may be performed until the detected residue is sufficiently reduced in the corresponding regions of the substrate.

Operations 702-708 of the method 700 may also be performed one or more additional times even if the determined difference performed in operation 708 is inside of a desired threshold to verify that the prior generated results remain within the desired threshold value at a subsequent time.

In operation 712, an indication of a lack of the residue at the substrate is provided in response to the difference determined during operation 708 being within the tolerance threshold. For example, if the traces are determined to have a sufficiently low difference or a trend toward a low difference over time (see FIG. 6B), the controller may indicate a lack of residue and stop or complete the polish operation or, alternatively, make a corresponding update reducing or otherwise adjusting the polishing operation accordingly. When the difference is within the tolerance threshold the method 700 may, as part of the operation 712, call end-point for the polishing process.

Examples of the present disclosure result in increased process yield through the identification and reduction of residue during the polishing operation. Since there is a direct correlation between residue detection and reduction and process yield, the increased residue reduction leads to an increase in process yield.

While the foregoing is directed to examples of the present disclosure, other and further examples of the disclosure may be devised without departing from the basic scope thereof, and the scope thereof is determined by the claims that follow.

What is claimed is:

1. A polishing apparatus for processing a substrate, comprising:

a polishing pad support;

a carrier head configured to hold a substrate and apply one or more independently controllable pressures to a plurality of regions of the substrate;

an in-situ monitoring system to monitor a characteristic of substrate within the plurality of regions during polishing; and a controller that includes computer program instructions that are stored in memory, which when executed by a processor of the controller cause:

(a) the carrier head to urge the substrate against a surface of a polishing pad positioned on the polishing pad support, wherein urging the substrate against the surface of a polishing pad includes applying the one or more independently controllable pressures to a surface of the substrate;

(b) the in-situ monitoring system to detect a first substrate measurement corresponding to a first region of the plurality of regions of the substrate;

(c) the in-situ monitoring system to detect a second substrate measurement corresponding to a second region of the plurality of regions of the substrate;

(d) the controller to determine that a slope of the first or the second series of measurement values is within a threshold slope;

(e) the controller to determine, based on determining that the slope of the first or the second series of measurement values is within a threshold slope, a difference between the first substrate measurement at the first region and the second substrate measurement at the second region; and (f) the controller to either:

stop the carrier head from urging the substrate against a surface of a polishing pad in response to a determination that the difference between the first substrate measurement and the second substrate measurement is within a tolerance threshold; or repeat (a)-(e) in response to a determination that the difference between the first substrate measurement and the second substrate measurement is outside of the tolerance threshold.

2. The apparatus of claim 1, wherein the controller is configured to detect at least one of the first substrate measurement or the second substrate measurement during the polishing.

3. The apparatus of claim 1, wherein the first substrate measurement forms part of a first series of measurement values, and the second substrate measurement forms part of a second series of measurement values.

4. The apparatus of claim 3, wherein, determining the difference between the first substrate measurement at the first region and the second substrate measurement at the second region comprises determining the difference between the first substrate measurement at the first region and the second substrate measurement by determining a maximum difference between the first substrate measurement and the second substrate measurement.

5. The apparatus of claim 3, wherein, determining the difference between the first substrate measurement at the first region and the second substrate measurement at the second region comprises determining the difference between the first substrate measurement at the first region and the second substrate measurement by determining a minimum difference between the first substrate measurement and the second substrate measurement.

6. The apparatus of claim 3, wherein, determining the difference between the first substrate measurement at the first region and the second substrate measurement at the second region comprises determining the difference between the first substrate measurement at the first region and the second substrate measurement by determining an average difference between the first substrate measurement and the second substrate measurement.

7. A polishing apparatus for processing a substrate, comprising:

a polishing pad support;

a carrier head configured to hold the substrate and apply one or more independently controllable pressures to a plurality of regions of the substrate;

an in-situ monitoring system to monitor a characteristic of substrate within the plurality of regions during polishing; and a controller that includes computer program instructions that are stored in memory, which when executed by a processor of the controller cause:

(a) polishing a surface of the substrate by causing the carrier head to urge the substrate against a surface of a polishing pad positioned on the polishing pad support;

(b) the in-situ monitoring system to detect a first substrate measurement corresponding to a first region of the substrate;

(c) the in-situ monitoring system to detect a second substrate measurement corresponding to a second region of the substrate;

(d) the controller to determine that a slope of the first or the second series of measurement values is within a threshold slope;

(e) the controller to determine, based on determining that the slope of the first or the second series of measurement values is within the threshold slope, a difference in the first substrate measurement relative to the second substrate measurement; and (f) the controller to provide an indication in response to the determined difference being outside of a tolerance threshold.

8. The polishing apparatus of claim 7, wherein the program instructions executed by the processor are further configured to cause the controller to update a chemical mechanical polishing operation based on the determined difference relative to the tolerance threshold.

9. The polishing apparatus of claim 7, wherein the program instructions executed by the processor are further configured to cause:

the in-situ monitoring system to detect a third substrate measurement corresponding to the first region of the substrate;

the in-situ monitoring system to detect a fourth substrate measurement corresponding to the second region; and the controller to provide an indication of a presence of a residue at the first region of the substrate or the second region of the substrate in response to the determined difference being outside of a tolerance threshold.

10. The polishing apparatus of claim 9, wherein the third substrate measurement and the fourth substrate measurement are completed after the first substrate measurement and the second substrate measurement, and the difference in time between the first substrate measurement and the third substrate measurement and the second substrate measurement and the fourth measurement substrate measurement correspond to at least a portion of the time that the polishing of the surface of the substrate is performed.

11. The polishing apparatus of claim 9, wherein the program instructions executed by the processor are further configured to cause the controller to:

detect a change in the difference with respect to the tolerance threshold; and reduce the polishing of the surface of the substrate based on a determination that the difference is within or approaching the tolerance threshold.

12. The polishing apparatus of claim 7, wherein the program instructions executed by the processor are further configured to cause the controller to provide an indication of a lack of the residue at the substrate in response to the difference being within the tolerance threshold.

13. The polishing apparatus of claim 7, wherein the tolerance threshold is a user input value.

14. The polishing apparatus of claim 7, wherein the tolerance threshold is determined based on a machine learning model.

15. A polishing apparatus for processing a substrate, comprising:

a polishing pad support;

a carrier head configured to hold the substrate and apply one or more independently controllable pressures to a plurality of regions of the substrate;

a controller that includes computer program instructions that are stored in memory, which when executed by a processor of the controller that cause to controller to:

(a) polish a surface of the substrate by causing the carrier head to urge the substrate against a surface of a polishing pad positioned on the polishing pad support;

(b) generate a first series of substrate measurements corresponding with a first region of the substrate;

(c) generate a second series of substrate measurements corresponding with a second region of the substrate;

(d) determine a slope of the first series of substrate measurements over time;

(e) determine a slope of the second series of substrate measurements over time;

(f) determine that the slope of the first series of substrate measurements or the slope of the second series of substrate measurements is within a threshold range;

(g) determine a difference between the first series of substrate measurements and the second series of substrate measurements, based on a determination that the slope of the first series of substrate measurements or the slope of the second series of substrate measurements is within the threshold range;

(h) stop the polishing of the surface of the substrate in response to a determination that the difference between the first series of substrate measurements and the second series of substrate measurements is within a tolerance threshold;

(i) indicate that the first series of substrate measurements and the second series of substrate measurements are outside the tolerance threshold in response to a determination that the first series of substrate measurements and the second series of substrate measurements is outside the tolerance threshold and update an aspect of the polishing the surface of the substrate and repeating (a)-(c) and (g); and (j) indicate that the first series of substrate measurements and the second series of substrate measurements cross into the tolerance threshold in response to a determination that the first series of substrate measurements and the second series of substrate measurements cross into the tolerance threshold.

16. The polishing apparatus of claim 15, wherein the program instructions executed by the processor are further configured to cause the controller to apply an inspection signal during the polishing of the surface of the substrate.

17. The polishing apparatus of claim 15, wherein the program instructions executed by the processor are further configured to cause the controller to adjust a polishing pressure.

18. The polishing apparatus of claim 15, wherein the program instructions executed by the processor are further configured to cause the controller to adjust at least one of a polishing speed, slurry composition, or slurry application rate.

* * * * *